US007114345B2

(12) United States Patent
Kim et al.

(10) Patent No.: US 7,114,345 B2
(45) Date of Patent: Oct. 3, 2006

(54) AIR CIRCULATION STRUCTURE FOR A REFRIGERATOR MACHINE ROOM

(75) Inventors: Yoon-Young Kim, Suwon (KR); Won-Jae Yoon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 285 days.

(21) Appl. No.: 10/690,500

(22) Filed: Oct. 23, 2003

(65) Prior Publication Data

US 2004/0163408 A1 Aug. 26, 2004

(30) Foreign Application Priority Data

Feb. 21, 2003 (KR) ..... 10-2003-0010888

(51) Int. Cl.
*F25D 19/00* (2006.01)

(52) U.S. Cl. ..... 62/296; 62/305; 62/427; 62/428

(58) Field of Classification Search ..... 62/428, 62/427, 455, 454, 296, 305, 309, 295; 181/212–218; 417/312
See application file for complete search history.

(56) References Cited

U.S. PATENT DOCUMENTS 3,712,078 A * 1/1973 Maynard et al. ..... 62/448
3,736,768 A * 6/1973 Harbour et al ..... 62/455
4,776,182 A 10/1988 Gidseg
5,199,273 A * 4/1993 Silva et al. ..... 62/298
5,729,997 A 3/1998 Witsoe ..... 62/407
5,881,567 A 3/1999 Junge et al.
6,094,934 A * 8/2000 Rand et al. ..... 62/440

FOREIGN PATENT DOCUMENTS

DE 721839 11/1942
DE 197 46 962 A1 4/1999
JP 02-103366 A * 4/1990

OTHER PUBLICATIONS

Kim, M. "Machine Room of Refrigerator having Noise Attenuating Structure", Feb. 15, 2001, Derwent, KR 2001/010605, all.*
Japanese Abstract 2001-82847 dated Mar. 30, 2001.

* cited by examiner

*Primary Examiner*—Mohammad M. Ali
(74) *Attorney, Agent, or Firm*—Staas & Halsey LLP

(57) ABSTRACT

A refrigerator which has a pleasant front appearance by improving a structure to circulate air through a machine room thereof, and which restrains a transmission of operational noise from an interior to an outside of the machine room, thus performing a silent operation. The refrigerator has a cabinet defining a storage compartment therein, and a machine room defined at a top of the cabinet. The machine room is partitioned in an interior thereof into front and rear chambers by a noise buffering plate having a plurality of vent holes. A main inlet hole and a main outlet hole are provided side-by-side at an upper surface of the front chamber of the machine room so as to allow air to circulate through the machine room. A compressor, a condenser and a cooling fan are installed in the rear chamber of the machine room.

15 Claims, 5 Drawing Sheets

AIR CIRCULATION STRUCTURE FOR A REFRIGERATOR MACHINE ROOM

CROSS-REFERENCE TO RELATED APPLICATIONS

This application claims the benefit of Korean Application No. 2003-10888, filed Feb. 21, 2003, in the Korean Intellectual Property Office, the disclosure of which is incorporated herein by reference.

BACKGROUND OF THE INVENTION

1. Field of the Invention

The present invention relates, in general, to refrigerators, and more particularly, to a refrigerator in which the machine room has an improved air circulation structure.

2. Description of the Related Art

Generally, refrigerators produce cool air using evaporators, and then supply the cool air into storage compartments contained in the refrigerator cabinets, thus preserving the freshness of stored foods. In accordance with the recent trend of consumer preference, the storage capacity of the refrigerators has increased greatly. Side-by-side style refrigerators, in which the refrigerator compartment and the freezer compartment are placed side-by-side have become increasingly popular. These side-by-side style refrigerators have become increasingly popular due to their food storage efficiency, both in terms of space and access to food, as well as to their ability to preserve food.

SUMMARY OF THE INVENTION

Accordingly, it is an aspect of the present invention to provide a refrigerator which has a pleasant frontal appearance by improving the machine room's air circulation structure.

It is another aspect of the present invention to provide a refrigerator which dampens transmission of operational noise from the interior of the machine room to the exterior, thus minimizing noise related disturbances.

Additional aspects and advantages of the invention will be set forth in part in the description which follows and, in part, will be obvious from the description, or may be learned by practice of the invention.

The foregoing and/or other aspects of the present invention are achieved by providing a refrigerator, including a cabinet defining a storage compartment therein, a machine room located at a top of the cabinet, and a main intake vent and a main exhaust vent located at an upper surface of the machine room so as to allow air to circulate through the machine room.

In one embodiment of the present invention, the machine room is horizontally and vertically formed along a front portion of the top of the cabinet, with the main intake vent and the main exhaust vent located side-by-side at the upper surface of the machine room.

The interior of the machine room is partitioned into front and rear chambers by a noise buffering plate having a plurality of vent holes. A compressor, a condenser and a cooling fan are installed in the rear chamber of the machine room.

An additional aspect of the present invention provides a partition plate is provided in the front chamber of the machine room so as to divide the interior of the front chamber into an intake chamber, communicating with the main intake vent, and an exhaust chamber, communicating with the main exhaust vent.

The vent holes are formed through the noise buffering plate such that a group of vent holes are formed at each side of the noise buffering plate to correspond to each of the main intake vent and the main exhaust vent.

In the refrigerator, the condenser, the cooling fan and the compressor are sequentially arranged in the rear chamber of the machine room in a direction from a position around the inlet hole to another position around the outlet hole.

In a further embodiment of the present invention, a sub-intake vent and a sub-exhaust vent are respectively provided at both side edges of the upper surface of the machine room to accomplish an auxiliary circulation of air through the machine room.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
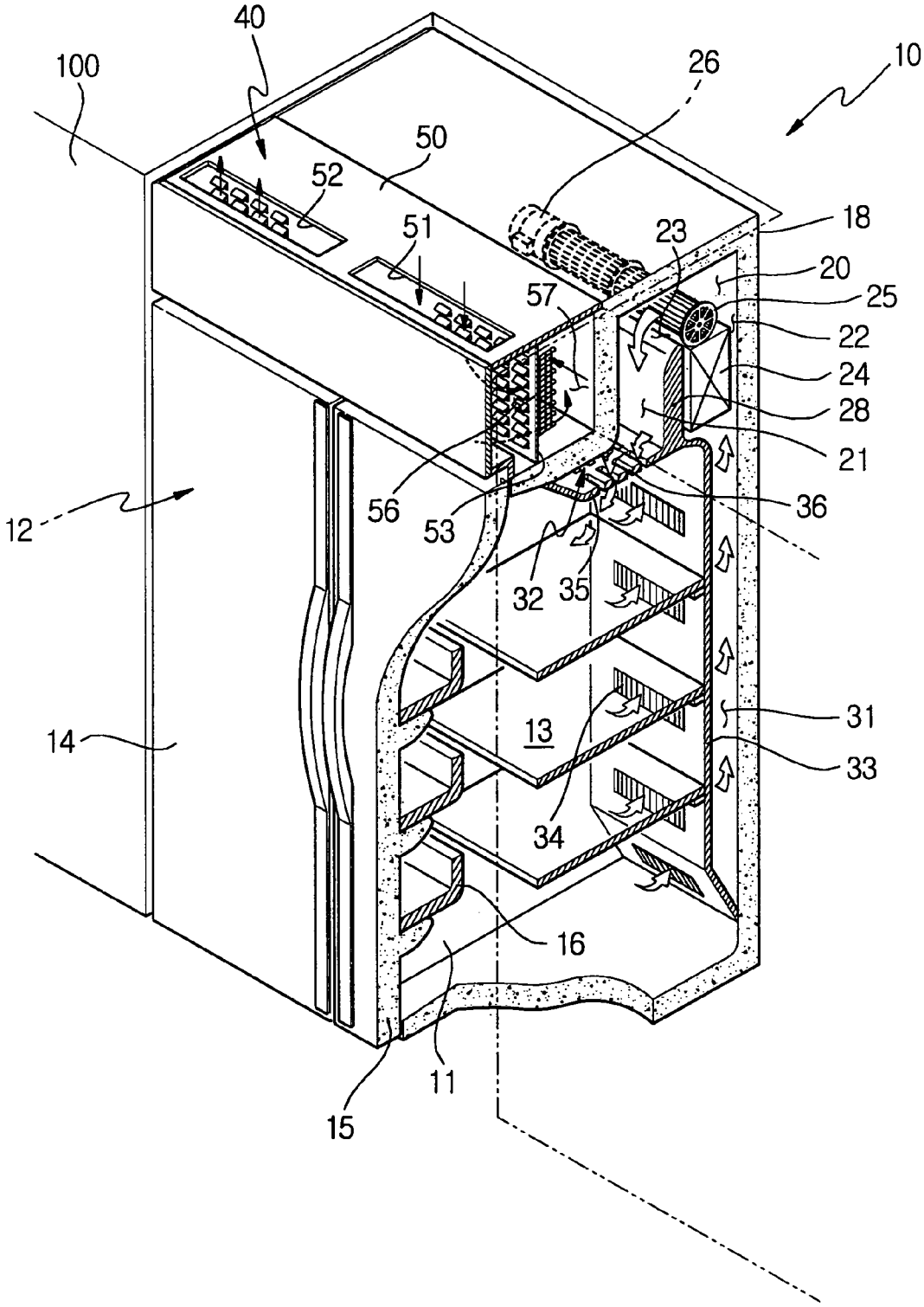
FIG. 1 is a partially broken perspective view showing a construction of a refrigerator, according to an embodiment of the present invention.

Reference will now be made in detail to the present preferred embodiments of the present invention, examples of which are illustrated in the accompanying drawings, wherein like reference numerals refer to like elements throughout.

Figure 2:
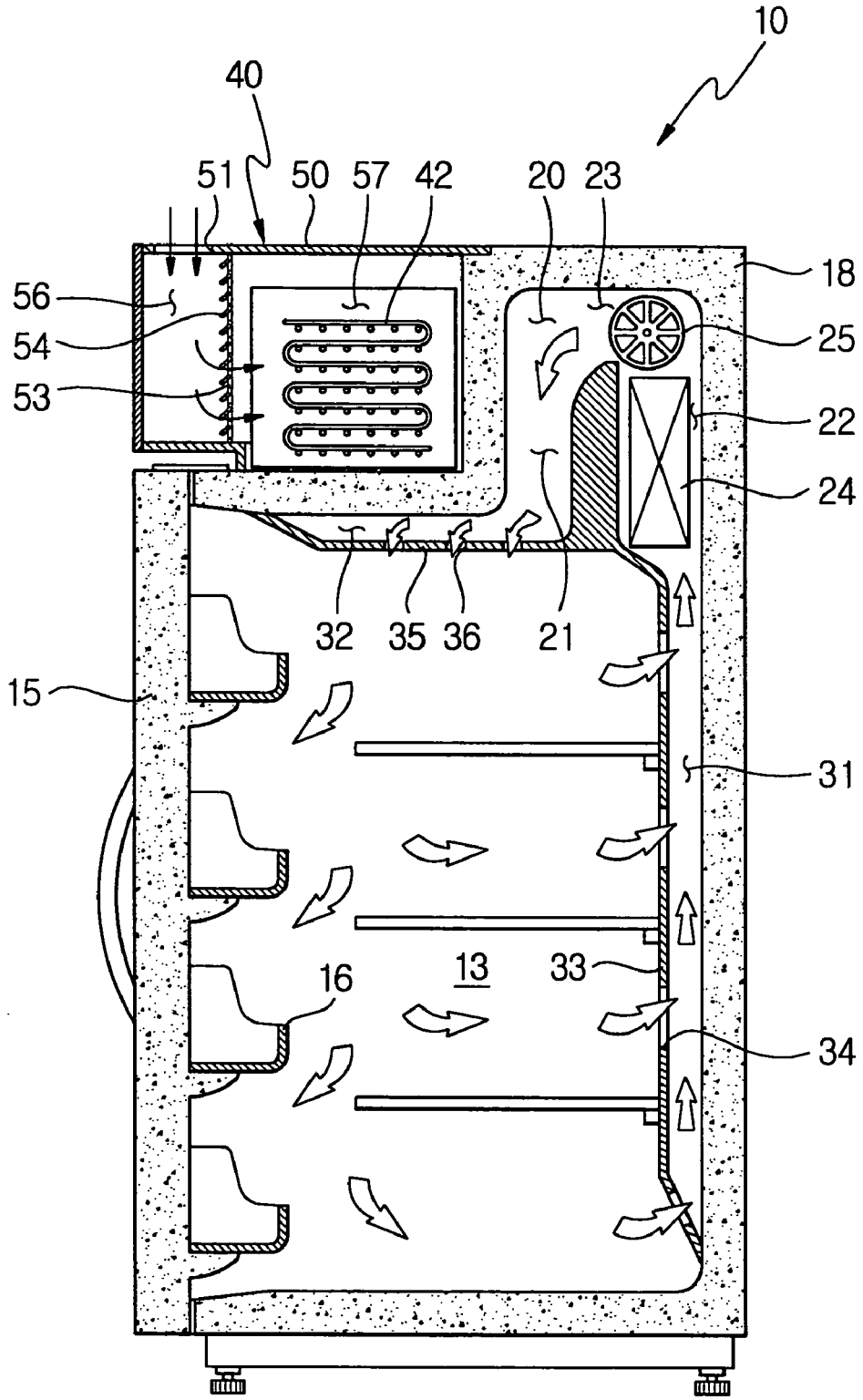
FIG. 2 is a side sectional view of the refrigerator of FIG. 1.

FIGS. 1 and 2 are views showing a construction of a refrigerator, according to an embodiment of the present invention. As shown in the drawings, a storage compartment defined in a cabinet 10 of the refrigerator is partitioned into left and right compartments by an intermediate partition wall 11. The left compartment forms a freezer compartment 12, while the right compartment forms a refrigerator compartment 13. A freezer compartment door 14 is mounted by hinges to an open front of the freezer compartment 12, and a refrigerator compartment door 15 is mounted by hinges to an open front of the refrigerator compartment 13, so that the freezer and refrigerator compartments 12 and 13 are closed or opened by the freezer and refrigerator compartment doors 14 and 15. A plurality of racks 16 are installed in each of the two compartments 12 and 13, and on an inner surface of each of the two doors 14 and 15 to store food in the two compartments 12 and 13.

A top of the cabinet 10 is projected upward at a rear portion thereof to form an upper projection 18. The upper projection 18 defines two air-cooling chambers 20 therein, with an evaporator 24 and a cool air circulation fan 25 installed in each of the two air-cooling chambers 20. Due to the upper projection 18, the upper sections of the freezer and refrigerator compartments 12 and 13 are extended upward along rear portions thereof to produce the two air-cooling chambers 20 which are horizontally and vertically formed along the rear portions of the upper sections of the freezer and refrigerator compartments 12 and 13, respectively. The upper projection 18 is integrated with the cabinet 10, and is formed with a wall made of a thermal insulation material in the same manner as the cabinet 10 to thermally insulate the air-cooling chambers 20 from the atmosphere. The two air-cooling chambers 20 are connected at their lower portions with the freezer and refrigerator compartments 12 and 13, respectively.

In addition, an air path partition plate 28 is provided in the air-cooling chamber 20 placed in the refrigerator compartment 11, as shown in FIG. 1, so as to partition the interior of the air-cooling chamber 20 into a front space 21 and a rear space 22. The air path partition plate 28 is spaced apart from an upper surface of the air-cooling chamber 20 by a predetermined gap, thus forming a flow path 23 through which the front and rear spaces 21 and 22 communicate with each other. The evaporator 24 is installed in the rear space 22 to produce cool air, and the cool air circulation fan 25 is installed in the flow path 23 above the evaporator 24. The cool air circulation fan 25 is a cross-flow fan which horizontally extends in the air-cooling chamber 20 so as to have a length almost equal to a length of the air-cooling chamber 20, and is positioned so as to be close to an upper edge of the air path partition plate 28. A drive motor 26 is connected to an end of the cross-flow fan 25. The cross-flow fan 25 thus forces air from the rear space 22 housing the evaporator 24 into the front space 21. In addition, the cross-flow fan 25 installed in the flow path 23 smoothly circulates the cool air through an entire area of the flow path 23, without resistance.

An air suction path 31 is provided at the rear portion of the refrigerator compartment 13 to allow the air to flow from the refrigerator compartment 13 into the rear space 22 housing the evaporator 24, when the cool air circulation fan 25 is operated. An air exhaust path 32 is provided at the upper portion of the refrigerator compartment 13 so as to uniformly discharge the cool air from the air-cooling chamber 20 into the entire area of the upper portion of the refrigerator compartment 13. The air suction path 31 is formed by a panel-type air suction guide member 33 which is vertically installed along a rear surface of the refrigerator compartment 13. The air suction guide member 33 is connected at its upper end to the lower end of the air path partition plate 28, thus forming a vertical channel between the air suction guide member 33 and the rear surface of the refrigerator compartment 13. A plurality of air suction ports 34 are formed through the air suction guide member 33. The air exhaust path 32 is formed by a panel-type air exhaust guide member 35 which is mounted to the upper surface of the refrigerator compartment 13 and is connected at its rear end to the lower end of the air path partition plate 28 and is spaced apart from the upper surface of the refrigerator compartment 13. A plurality of air exhaust ports 36 are formed through the air exhaust guide member 35. In an embodiment of the refrigerator of the present invention, the freezer compartment 12 has the same air path structure as that of the refrigerator compartment 13, so that the air path structure of the freezer compartment 12 is omitted from the description.

Figure 3:
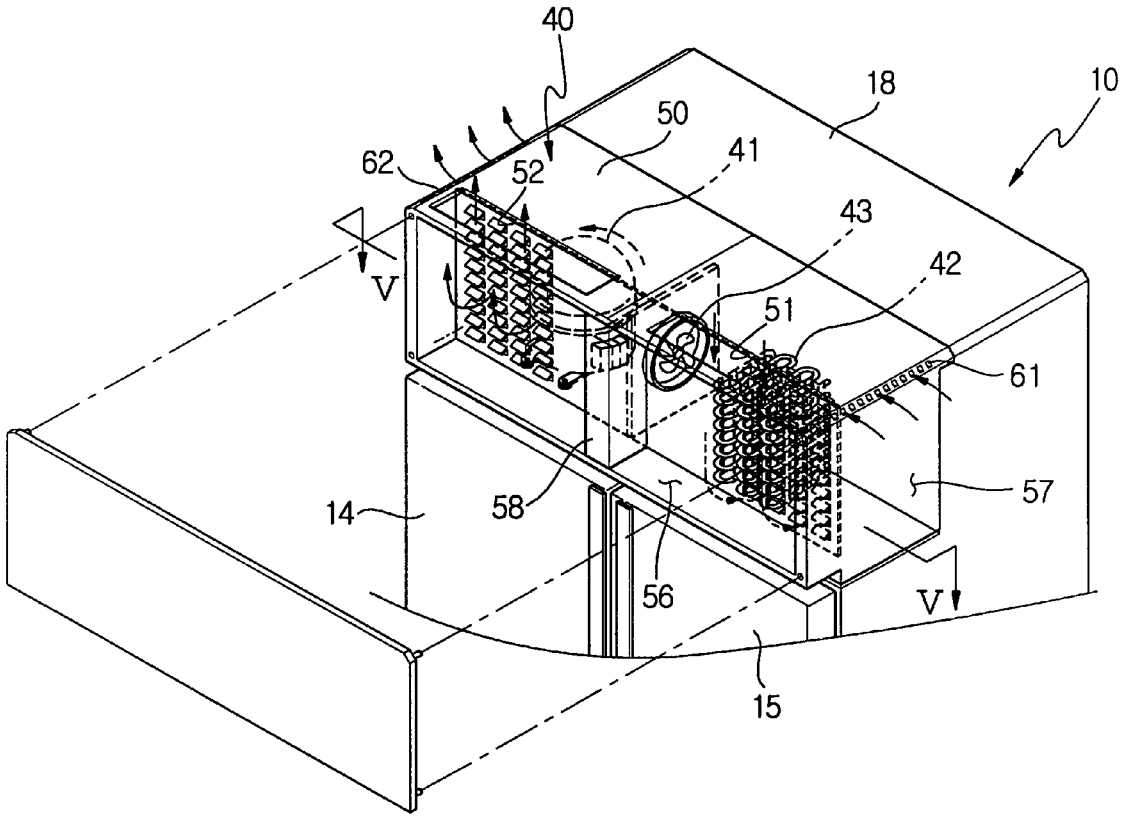
FIG. 3 is a perspective view showing a construction of a machine room included in the refrigerator of FIG. 1.
Figure 4:
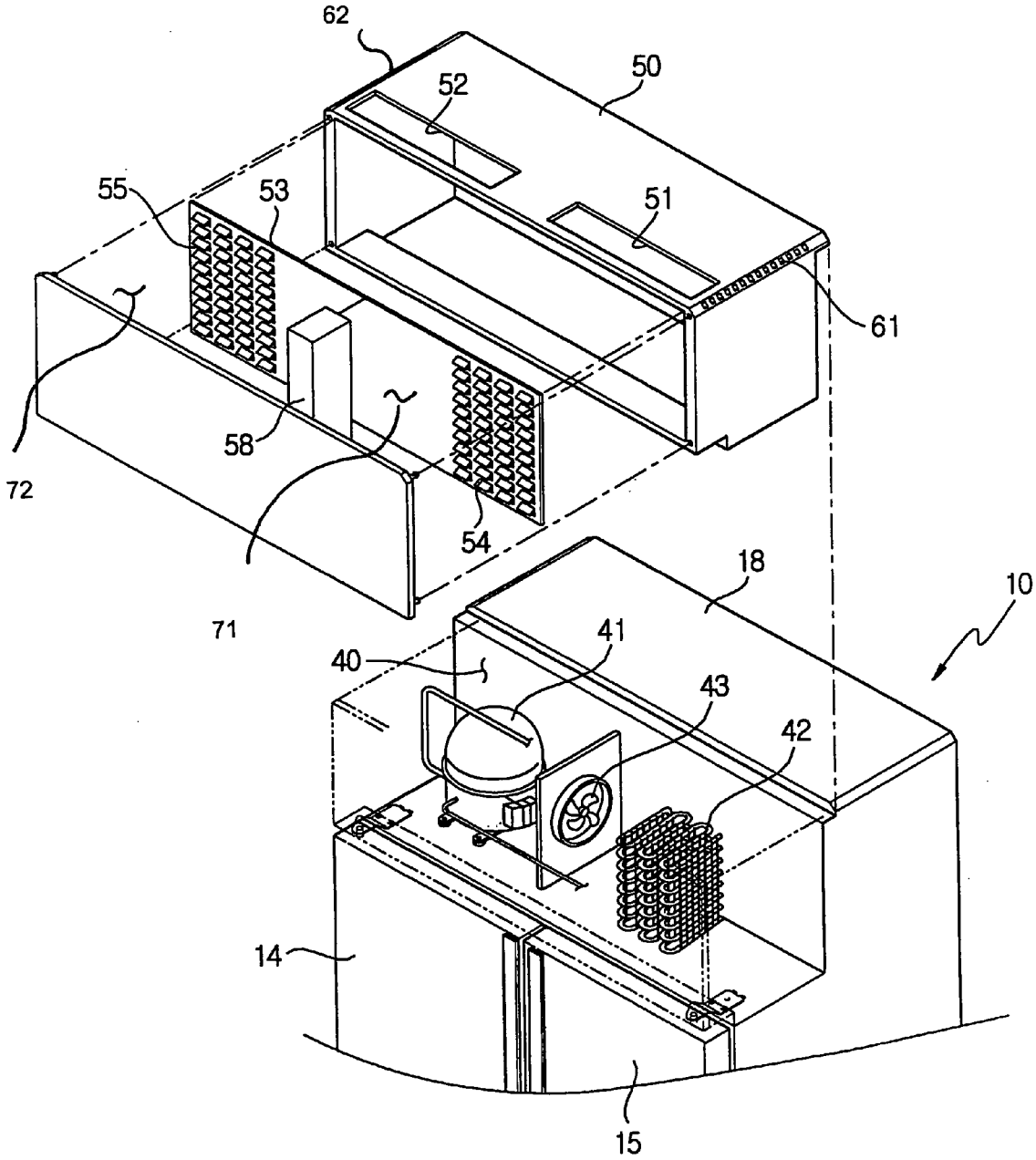
FIG. 4 is an exploded perspective view showing the construction of the machine room of FIG. 3.

As shown in FIGS. 3 and 4, a machine room 40 is horizontally and vertically formed on the top of the cabinet 10 at a position in front of the upper projection 18, and houses a variety of electric devices, such as a compressor 41, a condenser 42 and a cooling fan 43. The machine room 40 is defined by a machine room casing 50 which is installed at the top of the cabinet 10 and is closed at a front and both sides, with a main intake vent 51 and a main exhaust vent 52, located side-by-side at an upper surface of the machine room casing 50 so as to allow air to circulate through the machine room 40. A result of the above-described construction is a smooth circulation of the air through the machine room 40, resulting in effectively cooling the installed electric devices even when the refrigerator is installed to stand between walls 100 of a building, as shown in FIG. 1.

Figure 5:
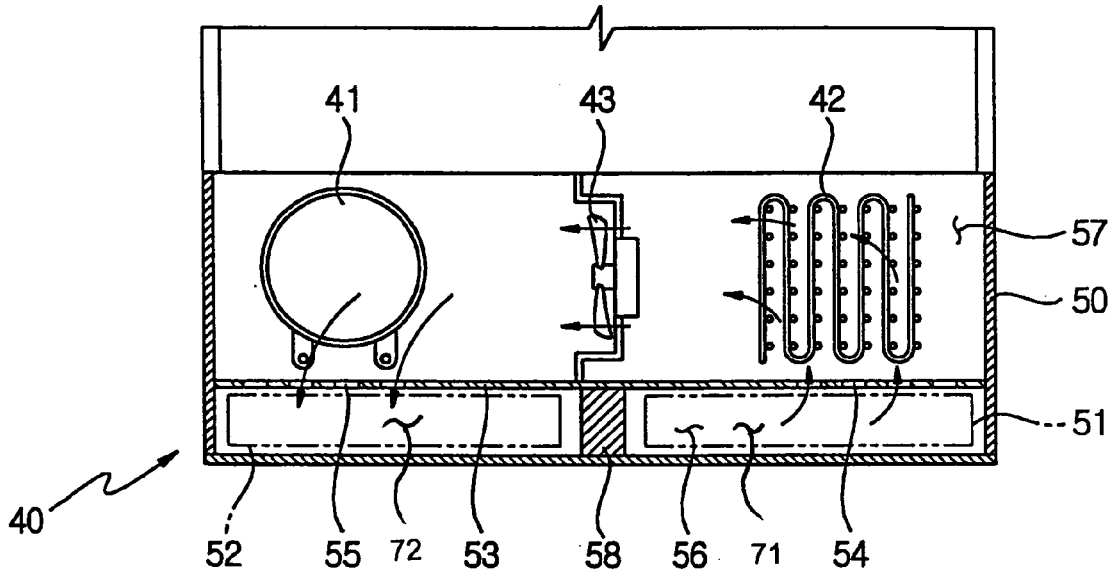
FIG. 5 is a sectional view taken along the line V–V' of FIG. 3.

As shown in FIGS. 2, 3 and 5, the interior of the machine room casing 50 is partitioned into front and rear chambers 56 and 57 by a noise buffering plate 53 having a plurality of vent holes 54 and 55. The compressor 41, the condenser 42 and the cooling fan 43 are installed in the rear chamber 57, while the main intake vent 51 and the main exhaust vent 52 are located side-by-side at the upper surface of the front chamber 56. A partition plate 58 is positioned in the front chamber 56 of the machine room casing 50 so as to divide the front chamber 56 into a front intake chamber 71 communicating with the main intake vent 51 and a front exhaust chamber 72 communicating with the main exhaust vent 52.

In the machine room 40, the noise buffering plate 53 allows air to circulate between the front and rear chambers 56 and 57 through the vent holes 54 and 55, but dampens the transmission of operational noise from both the compressor 41 and the cooling fan 43 to the main intake vent 51 or the main exhaust vent 52. The partition plate 58 divides the interior of the front chamber 56, thus preventing a mixing of intake air with exhaust air. In order to cause a smooth circulation of air through the machine room 40, the vent holes 54 and 55 are formed through the noise buffering plate 53 such that a group of vent holes 54 or 55 are formed at each side of the noise buffering plate 53 so as to correspond to each of the main intake vent 51 and the main exhaust vent 52. In addition, the condenser 42, the cooling fan 43 and the compressor 41 are sequentially arranged in the rear chamber 57 of the machine room 40 in a direction from a position around the main intake vent 51 to another position around the main exhaust vent 52. Due to the sequential arrangement of the condenser 42, the cooling fan 43 and the compressor 41 in the rear chamber 57 of the machine room 40, the inlet air primarily cools the condenser 42, and then flows to the compressor 41. The air is exhausted from the machine room 40, after cooling the compressor 41.

A sub-intake vent 61 and a sub-exhaust vent 62 are respectively provided at both side edges of the upper surface of the machine room casing 50 to accomplish an auxiliary circulation of air through the machine room 40. In an operation of the refrigerator, the air also circulates through the machine room 40 by way of the sub-intake vent 61 and the sub-exhaust vent 62, in addition to the main intake vent 51 and the main exhaust vent 52, thus more effectively cooling the machine room 40.

Since the main intake vent 51 and the main exhaust vent 52 are located side-by-side at the upper surface of the machine room casing 50, the refrigerator has a pleasant front appearance. In addition, the machine room casing 50, having the main intake vent 51 and the main exhaust vent 52 at the upper surface thereof, transmits the operational noise from both the compressor 41 and the cooling fan 43 in the machine room 40 to the atmosphere outside the upper surface of the machine room casing 50. The refrigerator thus restrains the operational noise transmitted to users in front of the refrigerator. In such a case, the transmission of the operational noise from both the compressor 41 and the cooling fan 43 in the machine room 40 to the outside of the upper surface of the machine room 40 is attenuated by the noise buffering plate 53, so that the operational noise transmitted to the outside of the refrigerator is remarkably reduced.

The air to cool the machine room 40 having the above-described construction circulates as follows.

As shown in FIGS. 3 and 5, the air is primarily drawn into the front chamber 56 of the machine room 40 through the main intake vent 51 formed at the upper surface of the front intake chamber 71 of the machine room 40, in response to the operation of the cooling fan 43. The inlet air then flows from the front intake chamber 71 into the rear chamber 57 of the machine room 40 through the vent holes 54 of the noise buffering plate 53. In the rear chamber 57 of the machine room 40, the air sequentially cools the condenser 42 and the compressor 41, and is the discharged into the front exhaust chamber 72 through the vent holes 55 of the noise buffering plate 53. The air is then discharged from the front exhaust chamber 72 of the machine room 40 to the atmosphere through the main exhaust vent 52.

During the air circulation, the partition plate 58 prevents a mixing of the intake air flowing from the main intake vent 51 with the exhaust air flow to the main exhaust vent 52. In addition, the auxiliary circulation of a small amount of air is accomplished through the sub-intake and sub-exhaust vents 61 and 62, thus enhancing the machine room cooling effect. As described above, the air circulation to cool the machine room 40 of the refrigerator according to the present invention is accomplished through the main intake and exhaust vents 51 and 52 formed at the upper surface of the machine room 40. The circulation of the air through the machine room 40 is thus effectively performed, even when the refrigerator is installed to stand between the walls 100 of the building, as shown in FIG. 1.

As is apparent from the above description, the present invention provides a refrigerator in which a main intake vent and a main exhaust vent that circulate air through a machine room are located side-by-side at an upper surface of the machine room. The main intake and exhaust vents are not visible to users, and the refrigerator has a pleasant front appearance.

Furthermore, since a transmission of operational noise from both a compressor and a cooling fan in the machine room to the atmosphere is attenuated by a noise buffering plate, the refrigerator remarkably reduces the operational noise transmitted to the atmosphere. Due to the main intake and exhaust vents formed at the upper surface of the machine room, the refrigerator restrains the operational noise transmitted to users in front of the refrigerator, and performs a silent operation which does not upset the users.

Although an embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a cabinet defining a storage compartment therein;

a machine room defined at a top of the cabinet;

a main intake vent and a main exhaust vent, located at an upper surface of the machine room so as to allow air to circulate through the machine room; and a noise buffering plate, to divide the machine room into a front chamber and a rear chamber, having a plurality of vent holes to allow air flow between the front chamber and the rear chamber, wherein the vent holes are formed through the noise buffering plate such that groups of the vent holes are formed respectively at each side of the noise buffering plate so as to correspond to the main intake vent and the main exhaust vent.

2. The refrigerator according to claim 1, wherein the machine room further comprises:

a compressor;

a condenser; and a cool air circulation fan, wherein;

the main intake vent, the condenser, the cool air circulation fan, the compressor, and the main exhaust vent are positioned sequentially along an air flow path.

3. The refrigerator according to claim 1, wherein the machine room is horizontally and longitudinally defined along a front portion of the top of the cabinet, with the main intake vent and the main exhaust vent provided side-by-side at the upper surface of the machine room.

4. The refrigerator according to claim 1, wherein the condenser, the cooling fan and the compressor are sequentially arranged in the rear chamber of the machine room with the condenser being proximate to the main intake vent, and the compressor being proximate to the main exhaust vent.

5. The refrigerator according to claim 1, further comprising a sub-intake vent and a sub-exhaust vent respectively provided at both side edges of the upper surface of the machine room to accomplish an auxiliary circulation of air through the machine room.

6. The refrigerator according to claim 2, further comprising a sub-intake vent and a sub-exhaust vent respectively provided at both side edges of the upper surface of the machine room to accomplish an auxiliary circulation of air through the machine room.

7. The refrigerator according to claim 1, wherein the front chamber comprises an intake chamber, an exhaust chamber, and a fan to provide fluid communication between the intake and exhaust chambers.

8. A refrigerator, comprising:

a cabinet defining a storage compartment therein;

a machine room defined at a top of the cabinet;

a main intake vent and a main exhaust vent, located at an upper surface of the machine room so as to allow air to circulate throuah the machine room; and a noise buffering plate, to divide the machine room into a front chamber and a rear chamber, having at least one vent hole to allow air flow between the front chamber and the rear chamber, wherein the front chamber further comprises a partition plate to divide the front chamber into a front intake chamber and a front exhaust chamber.

9. The refrigerator according to claim 8, wherein;

the main intake vent is located over the front intake chamber, and the main exhaust vent is located over the front exhaust chamber.

10. The refrigerator according to claim 9, wherein the main intake vent, the front intake chamber, a first set of the vent holes, the condenser, the cool air circulation fan, the compressor, a second set of the vent holes, the front exhaust chamber, and the main exhaust vent are positioned sequentially along an air flow path.

11. A refrigerator, comprising:

a cabinet defining a storage compartment therein;

a machine room defined at a top of the cabinet, comprising a compressor, a condenser, a cool air circulation fan, and a noise buffering plate, to partition the machine room into a front chamber and a rear chamber, the noise buffering plate having a plurality of vent holes to allow air flow between the front chamber and the rear chamber;

a partition plate, dividing the front chamber into a front intake chamber and a front exhaust chamber;

a main intake vent, located at an upper surface of the front intake chamber;

a main exhaust vent, located at an upper surface of the front exhaust chamber; and a sub-intake vent and a sub-exhaust vent respectively provided at both side edges of the upper surface of the machine room to accomplish an auxiliary circulation of air through the machine room.

12. The refrigerator according to claim 11, wherein the vent holes are arranged into a first vent hole group and a second vent hole group;

the first vent hole group being positioned between the front intake chamber and the rear chamber; and the second vent hole group being positioned between the front exhaust chamber and the rear chamber.

13. The refrigerator according to claim 12, wherein, by the force of the cool air circulation fan, cooling air;

is drawn through the main intake vent into the front intake chamber, passes through the noise buffering plate by way of the first vent hole group and into the rear chamber, cools the condenser, passes through the cool air circulation fan, cools the compressor, passes through the noise buffering plate by way of the second vent hole group and into the front exhaust chamber, and exits the machine room by way of the main exhaust vent.

14. A refrigerator, comprising:

a cabinet defining a storage compartment therein; and a machine room, comprising;

a compressor, a condenser, a cool air circulation fan, a main intake vent and a main exhaust vent to allow air to circulate through the machine room, and a noise buffering plate, the noise buffering plate positioned in the machine room to divide the machine room into a front chamber and a rear chamber and to dampen operational noise from the compressor, condenser, and air circulation fan, having at vent holes to allow air flow between the front chamber and the rear chamber, wherein the vent holes are formed through the noise buffering plate such that groups of the vent holes are formed respectively at each side of the noise buffering plate so as to correspond to main intake vent and the main exhaust vent.

15. The refrigerator according to claim 14, wherein the compressor, the condenser, and the cool air circulation fan are separated from the main intake vent and the main exhaust vent by the noise buffering plate, so as to limit operational noise transmission to an outside of the cabinet.

* * * * *

UNITED STATES PATENT AND TRADEMARK OFFICE

CERTIFICATE OF CORRECTION

PATENT NO. : 7,114,345 B2
APPLICATION NO. : 10/690500
DATED : October 3, 2006
INVENTOR(S) : Yoon-young Kim et al.

It is certified that error appears in the above-identified patent and that said Letters Patent is hereby corrected as shown below:

Column 6, Line 43, change “throuah” to --through--.

Column 8, Line 18, before “vent” delete “at”.

Signed and Sealed this

Twentieth Day of February, 2007

JON W. DUDAS
*Director of the United States Patent and Trademark Office*